166-274 SR
10/27/87 OR 4,702,318

United States Patent [19]

Chung et al.

[11] Patent Number: 4,702,318

[45] Date of Patent: Oct. 27, 1987

[54] INJECTIVITY PROFILE IN $CO_2$ INJECTION WELLS VIA BALL SEALERS

[75] Inventors: Harold S. Chung, Princeton, N.J.; Alfred R. Jennings, Jr., Plano; Edwin T. Strom, Dallas, both of Tex.

[73] Assignee: Mobil Oil Corporation, New York, N.Y.

[21] Appl. No.: 849,639

[22] Filed: Apr. 9, 1986

[51] Int. Cl.[4] ..... E21B 33/138; E21B 43/16

[52] U.S. Cl. ..... 166/274; 166/268; 166/284

[58] Field of Search ..... 166/268, 274, 281, 284; 428/407

[56] References Cited

U.S. PATENT DOCUMENTS

| | | | |
|---|---|---|---|
| 3,174,546 | 3/1965 | Flickinger | 166/284 X |
| 3,620,304 | 11/1971 | Hearn et al. | 166/274 |
| 3,749,171 | 7/1973 | Marx | 166/274 |
| 3,835,928 | 9/1974 | Strubbar et al. | 166/308 |
| 4,102,401 | 7/1978 | Erbstoesser | 166/284 |
| 4,244,425 | 1/1981 | Erbstoesser | 166/284 |
| 4,287,952 | 9/1981 | Erbstoesser | 166/284 |
| 4,407,368 | 10/1983 | Erbstoesser | 166/153 |
| 4,410,387 | 10/1983 | Halkerston et al. | 156/245 |
| 4,417,620 | 11/1983 | Shafir | 166/245 |
| 4,489,783 | 12/1984 | Shu | 166/272 |
| 4,505,334 | 3/1985 | Doner et al. | 166/284 |
| 4,513,821 | 4/1985 | Shu | 166/273 |
| 4,552,216 | 11/1985 | Wilson | 166/261 |
| 4,565,249 | 1/1986 | Pebdani et al. | 166/303 |

*Primary Examiner*—George A. Suchfield
*Attorney, Agent, or Firm*—Alexander J. McKillop; Michael G. Gilman; Charles A. Malone

[57] ABSTRACT

A method for diverting $CO_2$ injection in injection wells by the use of perforation ball sealers composed of polymer compounds covered with a thin coating of elastomer of low enough density to float in the injected fluids, yet able to stand the adverse temperatures of $CO_2$ injection.

6 Claims, 1 Drawing Figure

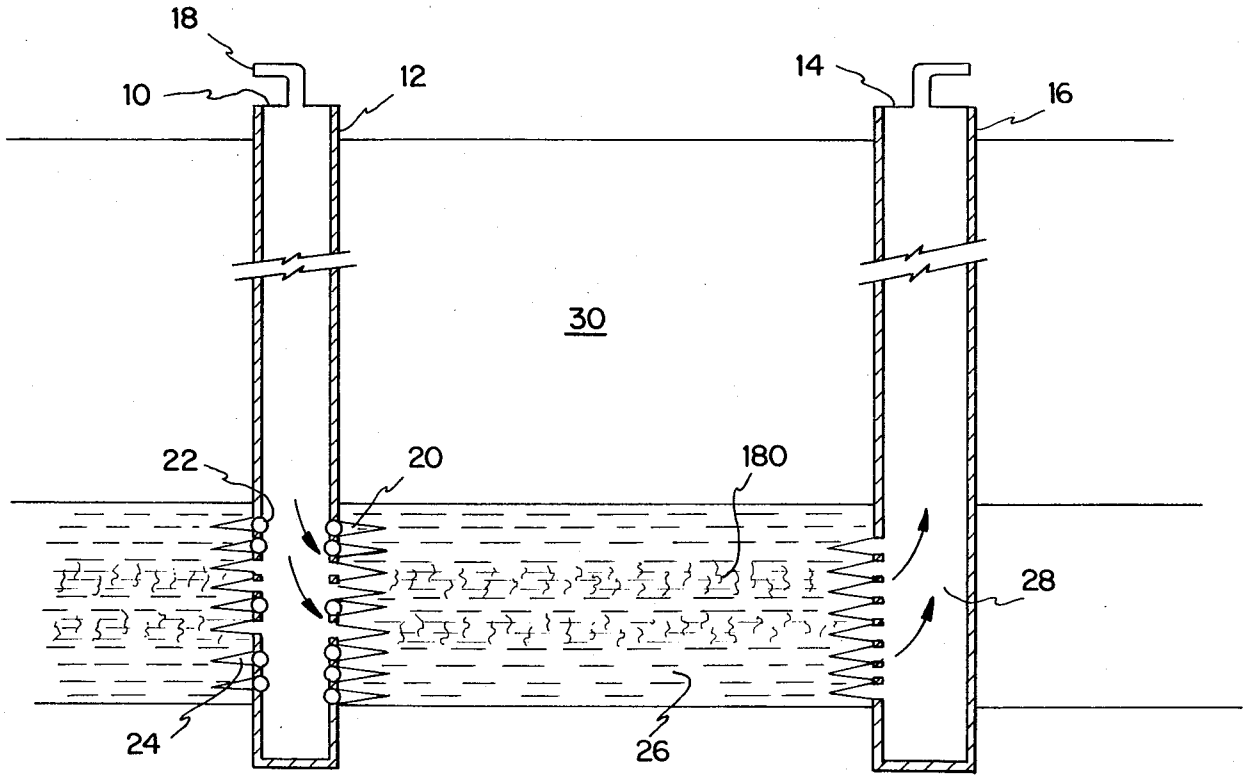
16
14
12
18
10
28
180
30
20
22
26
24

INJECTIVITY PROFILE IN $CO_2$ INJECTION WELLS VIA BALL SEALERS

FIELD OF THE INVENTION

This invention relates to a method for the recovery of hydrocarbonaceous fluids from a subterranean formation where carbon dioxide is used as the flood medium in combination with ball sealers in the injection well.

BACKGROUND OF THE INVENTION

This invention is related to co-pending application bearing Ser. No. 816,095 which was filed on Jan. 3, 1986 in the U.S. Patent and Trademark Office.

In many carbon dioxide ($CO_2$) injection wells, it is desirable to alter the injectivity of $CO_2$ to improve sweep of the formation. Mechanical isolation or diversion is not practical due to the cost of equipment.

Perforation ball sealers are used effectively in various stimulation treatments to divert treating fluids such as acids, solvents, and fracturing fluids. The adaptation and effective use of perforation ball sealers is well documented in the literature. U.S. Pat. Nos. 4,102,401; 4,244,425; and 4,287,952 issued to Exxon Corporation are examples of where perforation ball sealers have been used to divert treating liquids in formations. The prior art references do not show use of ball sealers in a $CO_2$ injection process during the recovery of hydrocarbonaceous fluids from a reservoir or formation. Therefore, what is needed is a method for utilization of ball sealers with a $CO_2$ injection process which follows a liquid treatment of a formation.

SUMMARY OF THE INVENTION

This invention is directed to a method to control the two perforations fluidly connected with zones of different injection profile in a $CO_2$ injection well which has at least permeabilities in a hydrocarbonaceous bearing formation. In the practice of this invention, a carrier liquid having ball sealers suspended therein is downwardly flowed into said well. Said ball sealers have a density less than the density of said carrier liquid, while being of a size sufficient to plug said perforations. Said ball sealers are of a composition sufficient to withstand the $CO_2$ injection temperature and pressure. The flow velocity of said carrier liquid is maintained at a rate sufficient to overcome the bouyancy of said sealers and is also sufficient to transport said sealers to the perforations, thereby closing off at least one zone of high permeability. Thereafter, $CO_2$ of a flow and a pressure sufficient to keep said sealers seated on the perforations is injected into the well. This causes the $CO_2$ to enter at least one zone of a lesser permeability while driving said carrier liquid ahead of said $CO_2$. The water and $CO_2$ combine to drive the hydrocarbonaceous fluids to a production well for removal from said well.

It is therefore an object of this invention to control the formation profile with ball sealers during $CO_2$ injection to remove hydrocarbonaceous fluids from areas of less permeability.

It is another object of this invention to use ball sealers to control the profile of a hydrocarbonaceous formation which formation has at least two zones of differing permeability fluidly connected to perforations in said well.

It is a further object of this invention to lower the cost of a $CO_2$ injection process through the use of ball sealers.

It is yet a further object of this invention to provide a method which gives greater flexibility when following a water flood process with a $CO_2$ injection process.

BRIEF DESCRIPTION OF THE DRAWING

The drawing is a schematic representation showing a hydrocarbonaceous formation penetrated by an injection well and a production well where ball sealers have closed perforations in the injection well so that $CO_2$ can enter through perforations into a zone of lesser permeability to remove hydrocarbonaceous fluids from the formation.

DESCRIPTION OF THE PREFERRED EMBODIMENTS

In the practice of this invention, referring to the drawing, water is pumped through conduit 18 into injection well 10. Included in the carrier liquid are perforation ball sealers 22. The water can be either fresh water or salt water. Well 10 is surrounded by a casing 12 which penetrates formation 30 and contains a zone of at least two different permeabilities. Well casing 12 contains perforations 24 which enter into the hydrocarbonaceous fluid producing formation.

Upon introducing the ball sealers 22 into the fluid upstream of the perforated areas of the casing 12, said sealers are carried down into the well 10 by the fluid flow. Once the fluid arrives at the perforated intervals 24, and into the strata being treated, the fluid is displaced outwardly through said perforations. The flow of the treating fluid through the perforations 24 carries the entrained ball sealers 22 toward said perforations 24 causing them to seat on the perforations 24. Once seated on the perforations, ball sealers 22 are held onto the perforations by the fluid pressure differential which exists between the inside of the casing and the producing strata of said formation on the outside of casing 12. Seated ball sealers 22 serve to effectively close the perforations 24 which have the greatest flow of the carrier liquid therethrough. Said perforations will remain sealed until such time as the pressure differential is reversed, and the ball sealers are released.

Said ball sealers 22 will tend to first seal the perforations through which the carrier liquid is flowing most rapidly. The preferential closing of the high flow rate perforation tends to equalize treatment of the production strata over the entire perforated interval.

For maximum effectiveness in seating on perforations 24, the ball sealers 22 preferably should have a density less than the density of the carrier liquid in the well bore at the temperature and pressure conditions encountered down hole. For example, it is not unusual for the bottom hole pressure to exceed 10,000 psi and even reach 15,000 psi during the well treatment procedure. Sealers and a method for use in well treatment with fluid diversions are discussed in U.S. Pat. Nos. 4,407,368 and 4,244,425 issued to Erbstoesser on Oct. 4, 1983 and Jan. 13, 1981, respectively. These patents are hereby incorporated by reference.

Once the ball sealers have seated themselves in the perforations, the carrier liquid injection is ceased. Thereafter, $CO_2$ injection is commenced by the injection of $CO_2$ into conduit 18 which forms a part of injection well 10. One method for injecting carbon dioxide into a reservoir is discussed in U.S. Pat. No. 4,565,249 which issued to Pebdani et al. on Jan. 21, 1986. Another carbon dioxide injection method is discussed in U.S. Pat. No. 4,552,216 which issued to R. Wilson on Nov. 12, 1985. U.S. Pat. No. 4,513,821 issued to W. R. Shu on Apr. 30, 1985 describes carbon dioxide injection. All three of these patents are hereby incorporated herein by reference.

Upon entering the injection well 10, the $CO_2$ pressure forces the water into the unblocked perforations in the area of the zone of low permeability causing water in that area to be forced therethrough. is injected into injection well 10 via conduit 18 and goes through the open perforations 24 where the ball sealers have not seated and force the hydrocarbonaceous fluid 180 as shown in the drawing into production well 14. The $CO_2$ enters production well 14 through perforations 28 and the hydrocarbonaceous fluids along with the $CO_2$ and water are removed from the production well 14 via conduit 32. Water in the hydrocarbonaceous formation remains in the high permeability zone 26 as is shown in the drawing.

Ball sealers which can be used in the practice of th invention and which are useful at the $CO_2$ temperature encountered, are composed of polymer compounds covered with a thin coating of elastomer of low enough density to float in the injected carrier fluid. The densities generally will be low and will be from about 0.8 to about 0.9 g/cc. The ball sealers will generally be of a diameter of about ¾ inch and will comprise a core wrapped therearound with an elastomer. Polymers which can be used to comprise the core include the following:

| Polymer | Density (g/cc) | Melting Point (°C./°F.) |
|---|---|---|
| Polystyrene | 1.11–1.12 | 240/464 |
| Poly-4-methyl-1-pentene | 0.81–0.83 | 250/482 |
| Poly-3-methyl-1-hexene | 0.83–0.86 | 288/550 |
| Poly-3-methyl-1-butene | 0.92–0.93 | 310/590 |
| Poly-4,4-dimethyl-1-hexene | 0.8–0.9 | 350/662 |
| Poly ortho-methylstyrene | 1.07 | 360/680 |
| Poly 4,4-dimethyl-1-pentene | 0.8–0.9 | 380/716 |

Ball sealers and a method of making same are disclosed in U.S. Pat. Nos. 4,244,425 and 4,410,387 which were issued to Erbstoesser and Halkerston et al. on Jan. 13, 1981 and Oct. 18, 1873, respectively. These patents are hereby incorporated by reference.

Obviously, many other variations and modifications of this invention, as previously set forth may be made without departing from the spirit and scope of this invention as those skilled in the art readily understand. Such variations and modifications are considered part of this invention and within the purview and scope of the appended claims.

What is claimed is:

1. A method to control the injection profile in a $CO_2$ injection well which has at least two perforations fluidly connected with zones of different permeabilities in a hydrocarbonaceous bearing formation comprising:

(a) downwardly flowing into said well a carrier liquid having ball sealers suspended therein, said ball sealers having a density less than the density of said carrier liquid while being of sufficient size to plug said perforations and of a composition sufficient to withstand the $CO_2$ injection temperature;

(b) maintaining the flow velocity of said carrier liquid at a rate sufficient to overcome the buoyancy of said sealers and sufficient to transport said sealers to the perforations thereby closing off at least one zone of high permeability; and (c) injecting $CO_2$ a flow and pressure sufficient to keep said sealers seated on the perforations which causes said $CO_2$ to enter a zone of lesser permeability driving said carrier liquid ahead of said $CO_2$, and which drive hydrocarbonaceous fluids to a production well for removal therefrom.

2. The method as recited in claim 1 where in step (a) said ball sealers contain an elastomeric covering and a core selected from a member of the group consisting of polystyrene, polymethylpentene, poly-3-methyl-1-hexene, poly-3-methyl-1-butene, poly 4,4-dimethyl-1-hexene, poly ortho-methylstyrene, and poly 4,4-dimethyl-1-pentene.

3. A method to control the injection profile in a $CO_2$ injection well which has at least two perforations fluidly connected with zones of different permeabilities in a hydrocarbonaceous fluid bearing formation comprising:

(a) downwardly flowing into said well water having ball sealers suspended therein, said ball sealers having a density less than the density of said carrier liquid while being of sufficient size to plug said perforations and of a composition sufficient to withstand the $CO_2$ injection temperature;

(b) maintaining the flow velocity of said water at a rate sufficient to overcome the buoyancy of said sealers and sufficient to transport said sealers to the perforations thereby closing off at least one zone of high permeability; and (c) injecting $CO_2$ of a flow and pressure sufficient to keep said sealers seated on the perforations which causes said $CO_2$ to enter a zone of lesser permeability, while driving said water ahead of said $CO_2$, and which drive hydrocarbonaceous fluids to a production well for removal therefrom.

4. The method as recited in claim 3 where in step (a) said ball sealers contain an elastomeric covering and a core selected from a member of the group consisting of polystyrene, polymethylpentene, poly-3-methy-1-hexene, poly-3-methyl-1-butene, poly 4,4-dimethyl-1-hexene, polyorthomethylstyrene, and poly 4,4-dimethyl-1-pentene.

5. The method as recited in claim 4 where said water is either fresh or salt water.

6. The method as recited in claim 1 where said carrier liquid is either fresh or salt water.

* * * * *

UNITED STATES PATENT AND TRADEMARK OFFICE

CERTIFICATE OF CORRECTION

PATENT NO. : 4,702,318

DATED : October 27, 1987

INVENTOR(S) : Harold S. Chung et al

It is certified that error appears in the above-identified patent and that said Letters Patent is hereby corrected as shown below:

Column 1, lines 37-41, "injection profile in a $CO_2$ injection well which has at least" should come before "two perforations fluidly connected with zones of different"

Column 3, line 11, Before "is injected" insert --Carbon dioxide--.

Column 4, line 2, after "hydrocarbonaceous" insert --fluid--.

Column 4, line 14, after "$CO_2$" insert --of--.

Signed and Sealed this

Nineteenth Day of April, 1988

*Attest:*

DONALD J. QUIGG

*Attesting Officer*

*Commissioner of Patents and Trademarks*